US010435907B2

(12) United States Patent
Waters, Jr. et al.

(10) Patent No.: US 10,435,907 B2
(45) **Date of Patent: *Oct. 8, 2019**

(54) FLOOD PROTECTION FOR UNDERGROUND AIR VENTS

(71) Applicant: Floodbreak, L.L.C., Houston, TX (US)

(72) Inventors: Louis A. Waters, Jr., Bellaire, TX (US); Nick Adam Eastman, Georgetown, TX (US)

(73) Assignee: Floodbreak, L.L.C., Bellaire, TX (US)

( * ) Notice: Subject to any disclaimer, the term of this patent is extended or adjusted under 35 U.S.C. 154(b) by 158 days.

This patent is subject to a terminal disclaimer.

(21) Appl. No.: 15/650,463

(22) Filed: Jul. 14, 2017

(65) Prior Publication Data

US 2017/0314808 A1 Nov. 2, 2017

Related U.S. Application Data

(63) Continuation-in-part of application No. 14/506,778, filed on Oct. 6, 2014, now Pat. No. 9,752,342.
(Continued)

(51) Int. Cl.
*E04H 9/14* (2006.01)
*E21F 1/08* (2006.01)
(Continued)

(52) U.S. Cl.
CPC ..... *E04H 9/145* (2013.01); *E02D 19/02* (2013.01); *E06B 9/04* (2013.01); *E21F 1/08* (2013.01);
(Continued)

(58) Field of Classification Search
CPC ..... E04H 9/145; E05Y 2800/428; E21F 1/08; E21F 1/16; E21F 17/103; E21F 17/12; E02D 19/02
See application file for complete search history.

(56) References Cited

U.S. PATENT DOCUMENTS 231,544 A 8/1880 Darst
930,829 A 8/1909 Bolling
(Continued)

FOREIGN PATENT DOCUMENTS

CN 201962783 9/2011
CN 102392686 3/2012
(Continued)

OTHER PUBLICATIONS

Search History PCT/US2017/042220.
(Continued)

*Primary Examiner* — Catherine A Kelly
(74) *Attorney, Agent, or Firm* — Tim L. Burgess, P.C.

(57) ABSTRACT

Apparatus allowing ventilation through a ventilation shaft to an underground ventilation duct fluidly communicating through the ventilation shaft to an atmospheric opening of the shaft and on threat of flooding operable to prevent downward flow of surface water into the ventilation duct includes support sidewalls fitting in the shaft providing a ventilation passage between support top and bottom openings and a suspension member supported on opposed lateral sidewalls proximate the top opening holding one or more hinge connected panels that manually release to rotationally close the passage and are manually rotationally liftable to a home position allowing ventilation. A panel drain automatically closes when the panel is raised to home position so it is already closed when the panel is released to rotationally close the passage.

18 Claims, 10 Drawing Sheets

Related U.S. Application Data

(60) Provisional application No. 61/887,416, filed on Oct. 6, 2013, provisional application No. 62/363,024, filed on Jul. 15, 2016.

(51) Int. Cl.

| | |
|---|---|
| ***E02D 19/02*** | (2006.01) |
| ***E06B 9/04*** | (2006.01) |
| *E05F 1/02* | (2006.01) |
| *E06B 9/00* | (2006.01) |

(52) U.S. Cl.

CPC ..... *E05F 1/02* (2013.01); *E05Y 2800/11* (2013.01); *E05Y 2800/252* (2013.01); *E05Y 2800/428* (2013.01); *E06B 2009/007* (2013.01)

(56) References Cited

U.S. PATENT DOCUMENTS

| | | | | |
|---|---|---|---|---|
| 1,556,328 | A * | 10/1925 | Hutchins | E02B 13/00 160/85 |
| 1,715,903 | A | 12/1925 | Dame | |
| 2,586,967 | A | 2/1952 | Lundy | |
| 2,741,972 | A | 4/1956 | Pryne | |
| 4,073,147 | A | 2/1978 | Nomura | |
| 4,474,167 | A | 10/1984 | McCabe | |
| 4,503,881 | A * | 3/1985 | Vecchio | E03F 7/04 137/425 |
| 5,201,685 | A * | 4/1993 | Raisanen | A01K 1/0058 454/259 |
| 5,711,343 | A | 1/1998 | Beckett | |
| 5,924,922 | A * | 7/1999 | Eakin | A01K 1/0058 454/256 |
| 5,980,381 | A | 11/1999 | McCormick | |
| 6,287,050 | B1 | 9/2001 | Montgomery et al. | |
| 6,533,656 | B2 * | 3/2003 | Hertel | F24F 13/1406 454/259 |
| 6,623,209 | B1 | 9/2003 | Waters, Jr. | |
| 6,685,557 | B1 * | 2/2004 | Hoffe | F24F 13/06 137/527.8 |
| 7,435,035 | B2 | 10/2008 | Cullen | |
| 7,467,911 | B2 | 12/2008 | Flury | |
| 7,600,944 | B1 * | 10/2009 | Keating | E04H 9/145 405/96 |
| 7,814,705 | B2 * | 10/2010 | Reed | E06B 9/04 49/31 |
| 7,926,539 | B1 | 4/2011 | Hurst | |
| 7,972,081 | B2 * | 7/2011 | Linares | E02B 3/104 405/105 |
| 8,033,753 | B2 * | 10/2011 | Waters, Jr. | E21F 1/08 405/96 |
| 9,004,814 | B2 * | 4/2015 | Petrillo | F24F 13/14 137/403 |
| 9,279,224 | B2 * | 3/2016 | Waters, Jr. | E02B 3/104 |
| 9,303,423 | B2 * | 4/2016 | Cadogan | E06B 9/13 |
| 9,315,965 | B1 * | 4/2016 | Adler | E04H 9/14 |
| 9,752,342 | B2 * | 9/2017 | Waters, Jr. | E05F 1/02 |
| 10,106,945 | B2 * | 10/2018 | Waters, Jr. | F24F 11/89 |
| 2008/0016780 | A1 | 1/2008 | McDougle et al. | |
| 2009/0185864 | A1 * | 7/2009 | Waters, Jr. | E21F 1/08 405/96 |
| 2009/0189404 | A1 | 7/2009 | Anderson | |
| 2011/0154563 | A1 | 6/2011 | Ball | |
| 2013/0209173 | A1 | 8/2013 | Quek | |
| 2014/0241804 | A1 | 8/2014 | Petrillo | |
| 2014/0242902 | A1 * | 8/2014 | Ali | F24F 13/14 454/359 |
| 2015/0133042 | A1 * | 5/2015 | Pearce | F24F 13/08 454/184 |
| 2016/0097212 | A1 | 4/2016 | Waters, Jr. | |
| 2018/0128002 | A1 * | 5/2018 | Quek | E04H 9/145 |

FOREIGN PATENT DOCUMENTS

| | | |
|---|---|---|
| DE | 202005012770 A1 | 7/2006 |
| EP | 2314356 | 4/2011 |
| JP | H04266037 | 2/1987 |
| JP | H10140592 | 5/1998 |
| JP | 2008133708 | 6/2008 |
| JP | 2005061201 | 3/2009 |
| JP | 4873498 | 2/2010 |
| KR | 200192098 | 8/2000 |
| KR | 2020020013062 | 4/2002 |
| KR | 200280864 | 6/2002 |
| KR | 1020100074363 | 7/2010 |
| KR | 20100123473 | 11/2010 |

OTHER PUBLICATIONS

International Search Report PCT/US2017/042220.
Written Opinion of the International Searching Authority PCT/US2017/042220.
Translation of EP2314356, Schwenzer, Apr. 27, 2011.
Translation of JP2008133708A, Sadahito, Jun. 12, 2008.
Translation of JPH10140592A, Kazuo, May 26, 1998.
Translation of JP4873498B2, Ito, Feb. 18, 2010.
Translation of KR200192098, Byum, Aug. 16, 2000.
Translation of CN201962783, Lin, Sep. 7, 2011.
Translation of KR2020020013062, Jeon, Apr. 29, 2002.
Translation of CN 102392686, Guisheng, Mar. 28, 2012.
Translation of KR200280864, Chung, Jul. 6, 2002.
Translation of JPH04026037, Masuda, Feb. 3, 1987.
Translation of KR1020080132763, Choi, Jul. 2, 2010.
Viking-F-1-Dry-Valve-Data-Sheet, The Viking Corporation, Mar. 28, 2013.
Round Backdraft Dampers Now Available from Greenheck, Greenheck, May 26, 2018.
Fire Dampers Type: Butterfiy 60min, (published prior to Aug. 17, 2016).

* cited by examiner

FLOOD PROTECTION FOR UNDERGROUND AIR VENTS

CROSS REFERENCE TO RELATED APPLICATION

This application is a continuation-in-part of and claims the benefit of U.S. application Ser. No. 14/506,778 filed Oct. 6, 2014, which claimed the benefit of U.S. Provisional Application No. 61/887,416, filed Oct. 6, 2013, as does this application, and further claims the benefit of U.S. Provisional Application No. 62/363,024, filed Jul. 15, 2016, the disclosures of all of which are incorporated herein by reference.

STATEMENT REGARDING FEDERALLY SPONSORED RESEARCH AND DEVELOPMENT

Not applicable

BACKGROUND OF THE DISCLOSURE

Technical Field

This invention relates to blocking flooding water from entering underground ventilation passages.

Background Art

Surface storm waters entering and flooding underground tunnels and chambers through ventilation ducts connecting the underground chambers or tunnels to air at ground surface affect without limitation, underground transportation tunnels for road vehicles, trains, and subways, and underground chambers, such as associated with a complex of connecting tunnels and shafts, for example as used for such things as underground hydroelectric-power plants, or with underground utilities which require ventilation, such as underground transformer rooms.

In a typical subway ventilation arrangement, ventilation ducts or shafts are incorporated into subway systems near stations to exhaust stale pushed air as the train nears a station and to pull in fresh outside air as a train leaves a station, Also reducing the "piston effect" of air being forced through the tunnels at high speeds by moving trains. Typically, a ventilation duct communicates from an underground tunnel and terminates in a ventilation shaft structure below grade level that opens to the atmosphere at grade level such as a sidewalk where the opening is covered by a subway grating.

Subways have systems for handling water. When it rains, water runs down stairwells, onto platforms and thence onto tracks, and some gets in the ventilation systems through the surface gratings. Drains beneath the tracks pipe water to underground sumps in pump rooms next to the subway tracks. Pumps pull the water up to pressure relief manholes open to the atmosphere at street level; from there the water drains under gravity flow into city storm sewers. The problem is that in heavy rains, storm sewers are overwhelmed and flush water back into the streets, flooding the streets with water inundates sidewalk and pours down through subway gratings into the ventilation system thence into the tunnels and onto the tracks. The pumping system can only return water to the flooded street; from there the water reenters the flood pool pouring into the ventilation system, defeating the pumping system as a means of controlling subway flooding. The problem is especially acute in cities like New York and Lower Manhattan, which is low-lying, vulnerable to storm surges and dotted with grade-level gratings, stairwells and other points of entry for running water into the subways.

One solution for reducing entrance of runoff water from sidewalk grating openings through the ventilation ducts down into the underground systems was raising the subway ventilation gratings above sidewalk level, as was done in some locations in New York City in Manhattan, Queens and Brooklyn after flooding from a severe rainstorm in 2007. This not only was costly to implement but also sacrificed much of the available sidewalk area available for pedestrians. In advance of the super storm Sandy in 2013, when predicted storm surge and high tides in addition to heavy rains signaled flooding of subways, workers resorted to sandbags and fastening plywood covers over subway ventilation gratings to try to prevent flooding. Sandy was testament to flood hazards of subways and vented subterranean structures. Fastening plywood covers over large numbers of air vent gratings in a short period of time as a solution is an imperfect labor and materials intensive process and can be too little too late, as was made clear by subway flooding from Sandy. A simpler, faster, relatively inexpensive and more effective method of preventing flooding through sidewalk air vent gratings is needed.

DESCRIPTION OF EMBODIMENTS

Figure 1:
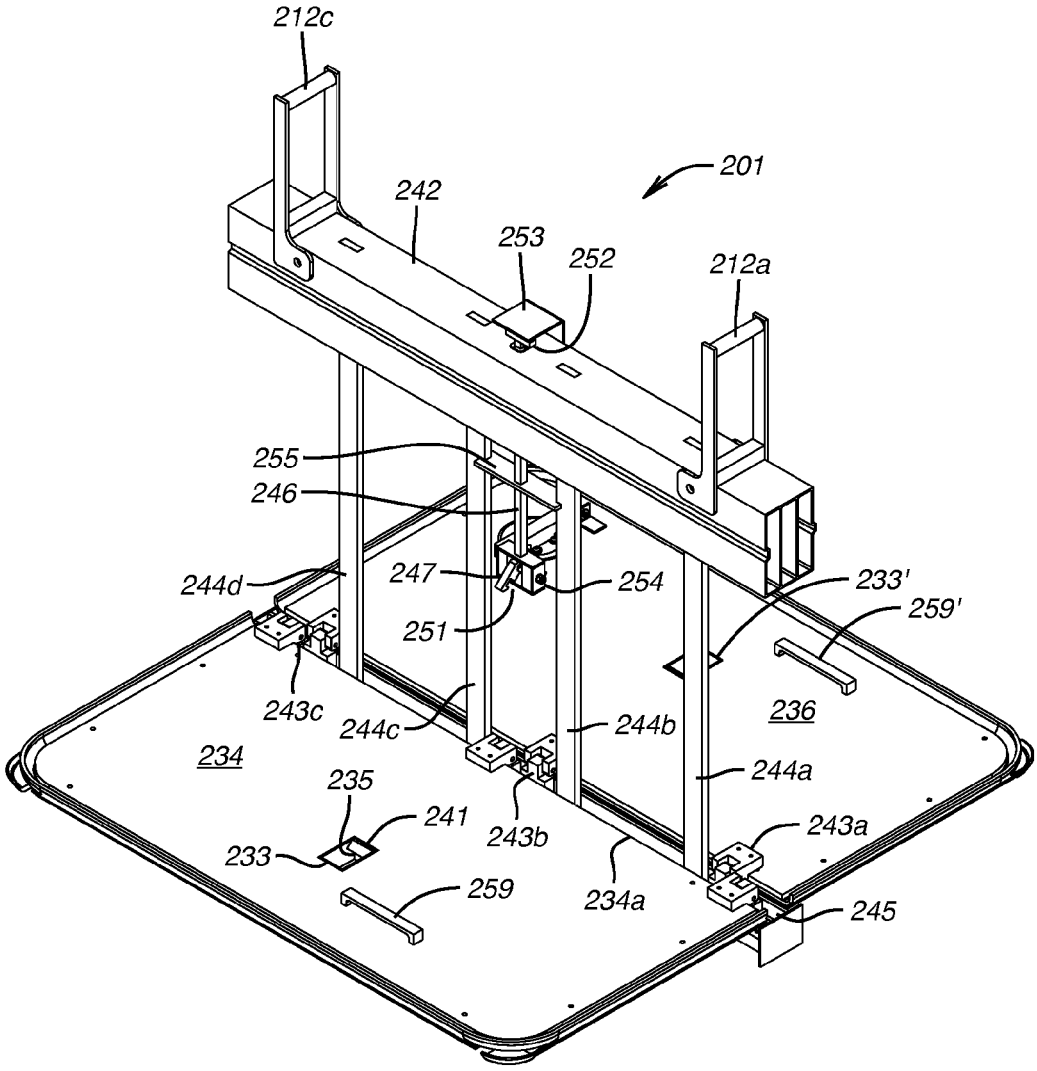
FIG. 1 is an isometric top view of a panel assembly with panels in lowered position.
Figure 3A:
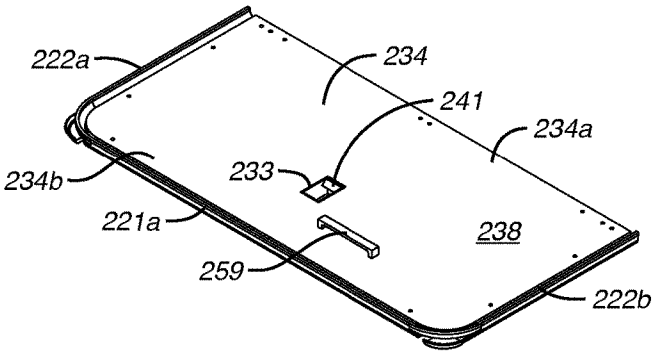
FIG. 3A is an isometric view of the top side of an embodiment of a panel on the left side of the embodiment of FIG. 1, from the same perspective of the panel as in FIG. 1.
Figure 3B:
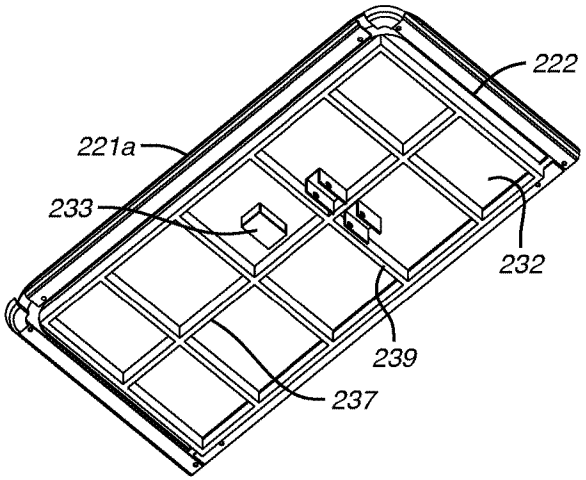
FIG. 3B is an isometric view of the bottom side of an the embodiment of a panel of FIG. 6A.

In accordance with this invention apparatus for installation in a ventilation shaft already fluidly communicating between an atmospheric opening and an underground ventilation duct allows the ventilation when there is no treat of flooding and on threat of flooding is manually operable to close ventilation from the atmospheric opening and prevent downward flow into the underground ventilation duct of surface water entering the atmospheric opening.

The concepts embodied in the exemplary embodiments of such apparatus described herein have application to any system in which an atmospheric opening communicates with a ventilation duct for an underground chamber or tunnel or other underground structure requiring ventilation, and through which opening substantial volumes of water can enter, whether by heavy rain or by storm surge propelled by hurricane or tropical storm or otherwise.

In the descriptions of exemplary embodiments of the invention that follow, reference is made to the accompanying drawings, which form a part hereof and in which are shown, by way of illustration, specific embodiments in which the invention may be practiced. Specific details disclosed herein are in every case a non-limiting embodiment representing concrete ways in which the concepts of the invention may be practiced. This serves to teach one skilled in the art to employ the present invention in virtually any appropriately detailed system, structure or manner consistent with those concepts. It will be seen that various changes and alternatives to the specific described embodiments and the details of those embodiments may be made within the scope of the invention. Because many varying and different embodiments may be made within the scope of the inventive concepts herein described and in the specific embodiments herein detailed, it is to be understood that the details herein are to be interpreted as illustrative and not as limiting.

The various directions such as "upper," "lower," "bottom," "top," "transverse", "perpendicular", "vertical", "horizontal," and so forth used in the detailed description of embodiments are made only with respect to easier explanation in conjunction with the drawings. The components may be oriented differently while performing the same function and accomplishing the same result as the embodiments herein detailed embody the concepts of the invention, and such terminologies are not to be understood as limiting the concepts which the embodiments exemplify.

The term "perpendicular" means substantially at a right angle to a reference to a degree that if not absolutely a right angle will not materially adversely affect the arrangement and function of the element described as perpendicular. The terms "vertical" or "vertically" include but are not limited to literal vertical and generally mean oriented up and down with respect to the earth's horizon to a degree that if not absolutely vertical will not materially adversely affect the function of the element described as vertical. Similarly, the terms "horizontal" or "horizontally" include but are not limited to literal horizontal and generally mean not out of level with respect to the earth's horizon to a degree that will materially adversely affect the function of the element described as horizontal.

As used herein, the use of the word "a" or "an" when used in conjunction with the term "comprising" (or the synonymous "having" or "including") in the claims and/or the specification may mean "one," but it is also consistent with the meaning of "one or more," "at least one," and "one or more than one." In addition, as used herein, the phrase "connected to" means joined to or placed into communication with, either directly or through intermediate components.

For components of described embodiments that are the same, in some cases the first mentioned component is identified by a given reference numeral, and the second such component is the same reference number marked with an apostrophe, for example "panel handle 259" identifies a first mentioned component, and the second such like component is identified as "panel handle 259'". Coupling the two reference numerals separated by a coma, for example "panel handles 259, 259'" means either component "panel handle 259" or "panel handle 259'" is being described unless the context means both are being described together.

For illustrative purposes of an application of the concepts herein disclosed for blocking entrance of water into a ventilation duct, the embodied concepts are described in reference to a specific ventilation environment. The exemplary application is for a subway system. In the specific embodiments described herein as examples, it is assumed the atmospheric opening through which flooding waters enter has a rectilinear shape, as for grating covered grade level sidewalk openings for subway ventilation systems, which at least in New York City typically are rectangular. Although the detailed descriptions of specific embodiments relate to a rectilinear shape and for a particular environment, the invention does not require that the opening be rectilinear or that embodiments of the invention conform to a rectilinear shape or that the atmospheric opening be at grade level. The elements of the invention can be configured to fit within downwardly vertically projected dimensions of any ventilation shaft surface opening serving any underground tunnel, chamber, room or other underground structure, whether rectilinear, circular or oval or some other shape.

In the descriptions of exemplary embodiments that follow, the passage closing position is one in which the panel or panels of the embodiments are horizontal. The concept of the invention is not limited to this disposition. Restrains or stops for stopping panel lowering may be positioned to stop the downward travel above horizontal and still close a ventilation passage. The described embodiments are non-limiting illustrations of examples in which the concepts of the invention may be implemented.

The exemplary embodiments of the invention comprise a ventilation shaft manual closure assembly. Support for the exemplary assembly embodiment includes opposed lateral sidewalls for arrangement in a vertical ventilation shaft to an underground ventilation duct fluidly communicating through the ventilation shaft to an atmospheric opening of the shaft. The atmospheric opening may be cylindrical and the support cylindrical. The atmospheric opening may be rectilinear and the support quadrilateral. As mentioned, in the exemplary embodiments, the atmospheric opening is rectilinear.

The support inclusive of the lateral sidewalls is sized to internally fit in the vertical shaft between the ventilation duct and the atmospheric opening. In an exemplary embodiment, the support has horizontal flanges transverse to the sidewalls for projection across a top of the shaft to hang the support in the shaft. The support defines a passage between top and bottom openings of the support for fluid communication of the ventilation duct up through the support to the atmospheric opening.

In an exemplary embodiment, one or more downwardly rotatable panels may be used, mounted in an upright home position not obstructing the ventilation passage that fluidly communicates the underground ventilation duct with the atmospheric opening of the ventilation shaft, to allow ventilation as usual when there is no flooding threat. In one exemplary embodiment, a single panel is mounted in the home position to a side of such a passage to alone gravitationally fall from home position to a passage closing position across the entirety of the passage to protect the underground ventilation duct from flooding. In another exemplary embodiment, a pair of panels is mounted on opposite sides of the passage, to gravitationally fall from home position down toward each other to passage closing positions to combine to close the passage. In yet another exemplary embodiment, a pair of panels is mounted centrally in the passage for rotation of the panels in directions opposite each other from the home position to a lower passage closing position. An advantage of paired panels is that they may be used to close a passage that is wider than it would be feasible for a single taller panel to close.

The manual closure assembly comprises one or more panels having proximal and distal ends, a top side and a bottom side. The proximal end connects with a horizontal hinge having an axis perpendicular to the opposed lateral sidewalls for manual rotation of a panel upwardly to an upright home position not obstructing the passage and rotation from the home position downwardly solely by gravitational impetus of its own weight to reach a lower passage closing position. The one or more panels have a profile that closes the passage when each panel gravitationally rotates to the passage closing position.

At least one restraint limits the downward rotation of each panel to the lower passage closing position. The restraint may be one or more foldable or flexible members anchored at one end to an upper portion of a suspension member (next mentioned) and fastened at the other end to the topside of a panel, or it may comprise one or more stops that do not obstruct the passage and that are located within and connected to the support proximate the bottom opening.

In an exemplary embodiment, adjacent sidewalls include a base having rounded corners with a first radius of curvature and in which the distal portions of the panels have rounded corners with a radius of curvature substantially the same as the first radius of curvature of the sidewall corners they sweep when rotating to the passage closing position. In an exemplary embodiment, the panels include seals for sealing the passage in the passage closing position.

A suspension member unobstructively horizontally spans the passage proximate the support top opening and holds the one or more hinge connected panels in the passage. The suspension member is supported on the opposed lateral sidewalls proximate the support top and bottom openings. The suspension member has at least one handle connected to the suspension member for holding the suspension member to move it vertically into or out from the supports on the opposed lateral sidewalls. The suspension member may comprise a single unitary vertically extending member holding the horizontal hinge and the panels connected to the hinge, or may comprise a beam having vertically hung straps holding the horizontal hinge and the panels connected to the hinge. In an exemplary embodiment, the horizontal hinge comprises a hinge mounting member held by the suspension member and a plurality of hinge members mounted on the hinge mounting member. In an exemplary embodiment, each hinge member comprises a stationary member, a movable member and a hinge pin interconnecting the stationary and movable members, the stationary member connecting to the hinge mounting member, and the moveable hinge member connecting to the proximal end of a panel. The horizontal hinge may also comprise a continuous hinge, sometimes called a piano hinge, or any other hinge for panels.

In an exemplary embodiment, the suspension member is supported centrally between the opposed lateral sidewalls, and suspends a pair of panels in the ventilation passage for rotation of the panels in directions opposite each other from or to said upright home position. In an exemplary embodiment in which the atmospheric opening is rectilinear and said support is quadrilateral, such centrally supported suspension member comprises a beam having vertically hung straps holding the horizontal hinge and the panels connected with said horizontal hinge. In such exemplary embodiment, the opposing sidewalls each attach centrally in the ventilation passage adjacent the top opening of the shaft a cradle having a pair of spaced apart parallel vertical bars connecting to and standing upright on a horizontal bar for receiving and supporting the beam within such vertical bars and on the horizontal bar.

In an exemplary embodiment, a panel holder for holding each the panel in the upright home position comprises a latch carried by the suspension member below the suspension member, and a latch catch carried by the panel, the latch capturing and holding the latch catch when the panel is rotated upwardly to the home position. The embodiment further comprises a panel releaser for the panel holder comprising linkage connected to the panel holder carried by the suspension member, the linkage being vertically movable relative to the suspension member to translate the latch to cause it to lose capture of the catch and release the panel from the upright home position, allowing the panel to gravitationally rotationally fall to the lower passage closing position.

In an exemplary embodiment, a drain is provided in at least one of the one or more panels intermediate the proximate and distal ends thereof. The drain comprises a conduit passing though the panel. The conduit has an aperture at the panel top side. The drain includes a self actuating drain closure. The closure comprises a plug pivoting rotatably on a drain plug axis positioned between the drain conduit and the distal end of the panel having the drain. The drain plug axis parallels the horizontal hinge axis of the panels. The plug is manually pivotable upwardly on the drain plug axis to remove the plug from the drain opening to drain water contained above the one or more panels when the one or more panels is in the passage closing position. The plug by gravitational impetus of its own weight automatically pivots downward to place the plug in the conduit opening when the panel containing the drain is pivotally raised upward to the home position, then when the panel gravitationally rotates downwardly to the passage closing position, the drain opening is already closed.

In an exemplary embodiment, the self actuating drain closure plug includes an upwardly concave sealing gasket around the plug periphery to seal any space between the plug periphery and the conduit opening when the panel containing the plug is in the passage closing position.

In an exemplary embodiment a panel containing a self actuating drain closure has a pair of spaced posts fixedly mounted to the top side of the panel between the drain and the distal end of each the panel. The drain plug axis comprises a rod spanning between the posts supported by the posts parallel to the horizontal hinge axis and above the panel top side. The drain closure comprises a plug arm pivotally rotatable at a proximal end of the arm with or on the rod for movement of the arm to a raised drain opening position and to a lowered drain closing position. The rod may be fixed to the posts with the plug arm rotating on the rod, or the plug arm may be fixed to the pivot axis rod with the rod rotating in the posts. The plug arm is weighted to place the center of gravity of the plug arm remotely from the rod. The plug arm comprises an attachment projection remote from the rod, an upwardly concave sealing gasket, a top plate and a bottom plate. The top and bottom plates are both smaller in size than the gasket. The concave sealing gasket is secured between the top and bottom plates, at least the bottom plate being of size configured to enter and plug the conduit opening. The plates expose an outer upwardly concave gasket portion extending above the bottom plate. The plates are fixedly connected to the arm at the attachment projection locating the center of gravity of the arm remotely past the pivot axis of the rod in the direction of the drain, so that after a plug arm is raised from the drain opening to empty water above the panel while the panel is in the passage closing position, rotating the panel upwardly toward the home position causes the plug arm solely by reason of gravity acting on the center of gravity of the raised plug arm, to automatically rotate downwardly from the position raised for draining the panel to a position parallel to the panel, placing at least the bottom plate in the drain conduit opening closing the opening with the outer upwardly concave gasket portion sealing space between the plates and the opening. In an exemplary embodiment the plug arm includes a relief on an underside of the arm distal from the rod for capture of the arm by an arm lifting reach tool.

Figure 5:
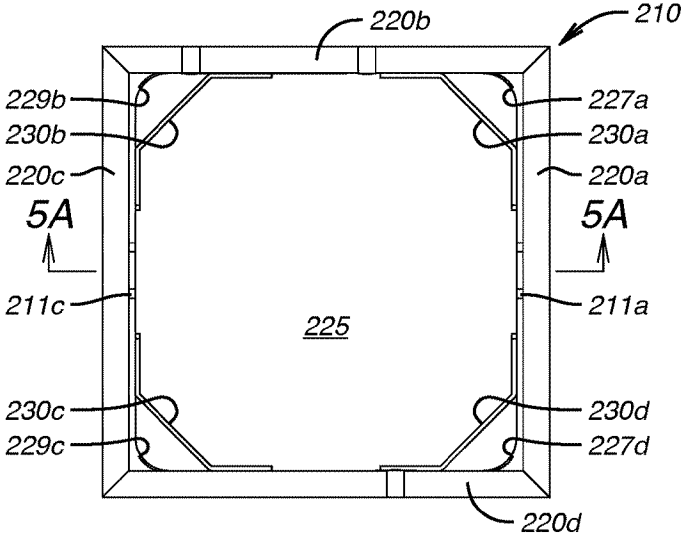
FIG. 5 is a top plan view of the quadrilateral embodiment of FIG. 1.
Figure 5A:
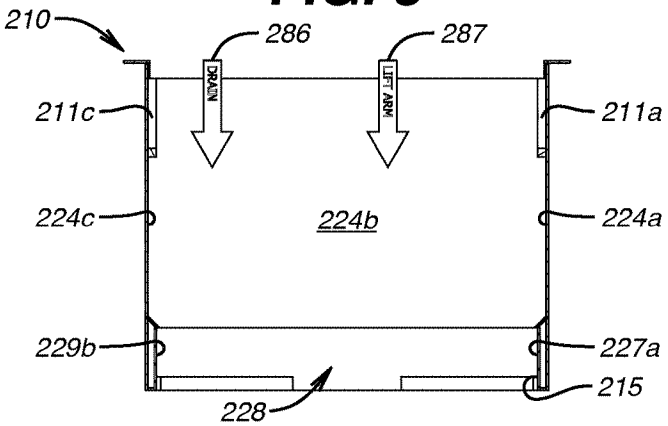
FIG. 5A is a cross section view of the quadrilateral embodiment of FIG. 1 taken along the lines 2A-2A of FIG. 2.
Figure 4:
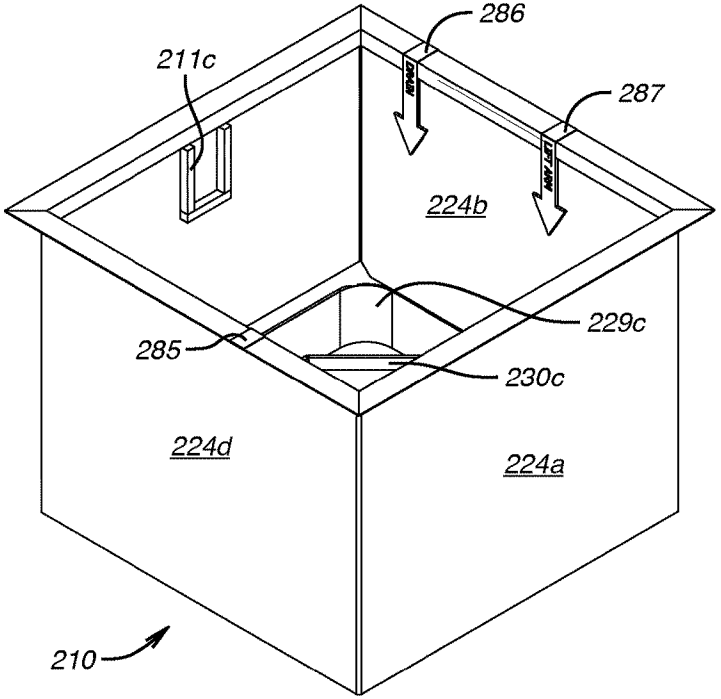
FIG. 4 is an isometric view of a quadrilateral (four sided) support structure for receiving the embodiment of FIG. 5
Figure 18:
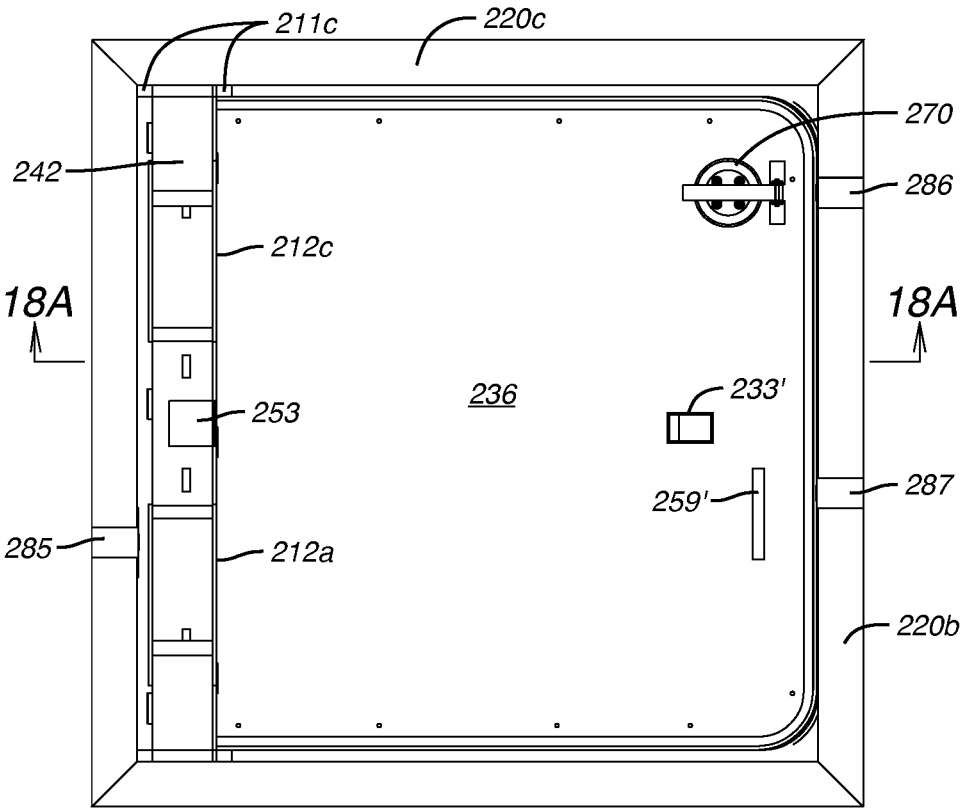
FIG. 18 is a top plan view of a single panel assembly received in a quadrilateral support showing the panel deployed in a passage closed position.
Figure 19:
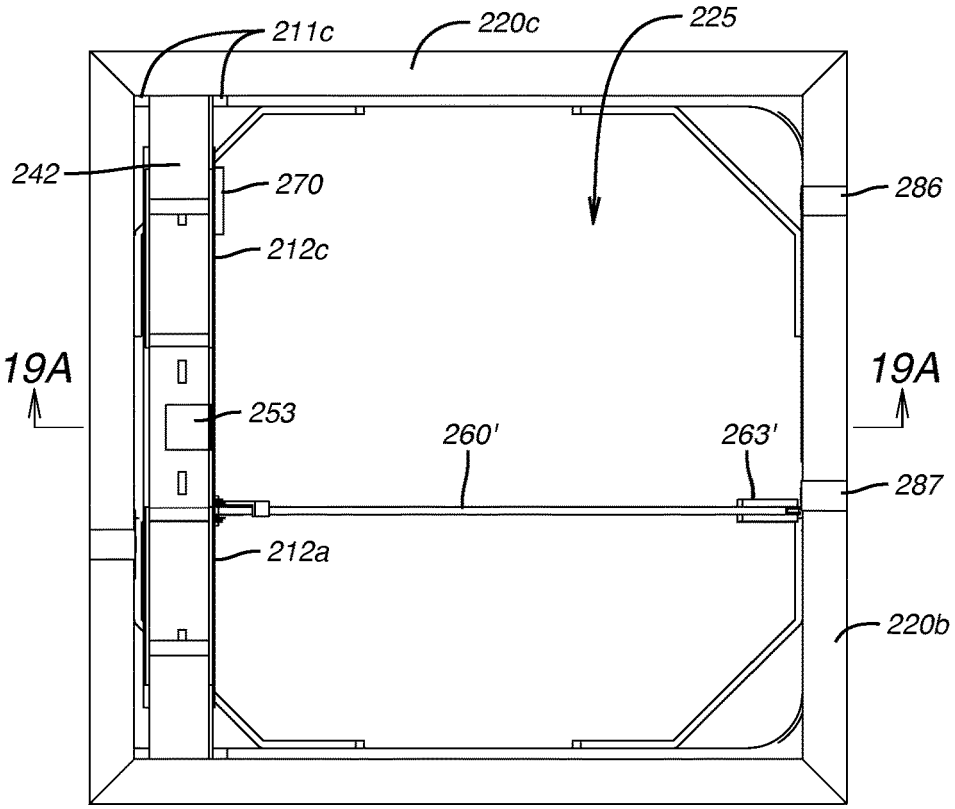
FIG. 19 is a top plan view of a single panel assembly received in a quadrilateral support showing the panel completely raised to home position
Figure 19A:
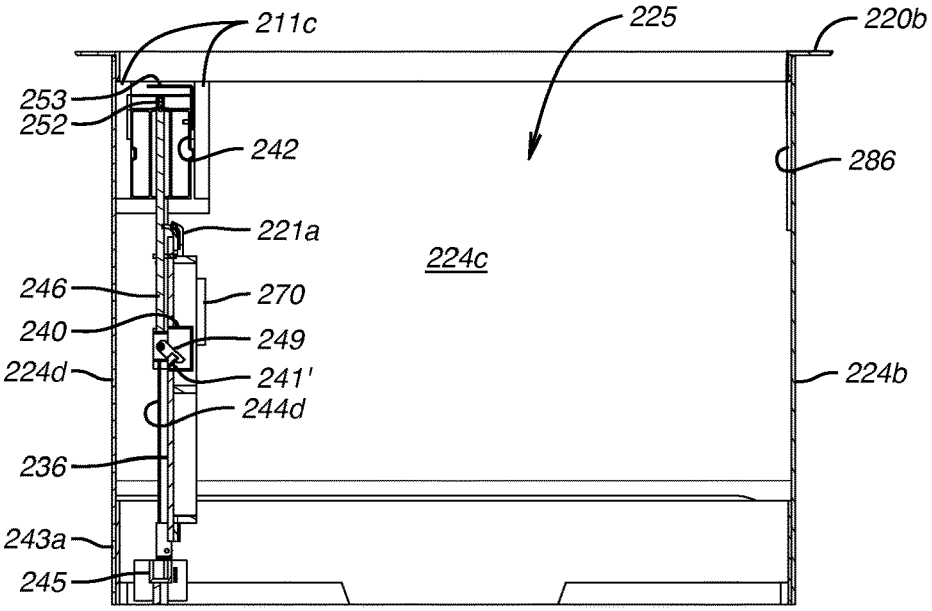
FIG. 19A is a cross sectional view of the embodiment of FIG. 19 taken along the line 19A-19A of FIG. 19.

Turning now to the drawings, they show exemplary embodiments of an apparatus for preventing downward flow of surface water into an underground ventilation duct fluidly communicating through a ventilation shaft to a rectilinear atmospheric opening of the shaft. FIGS. 1-7 show exemplary embodiments having a pair of panels. FIGS. 18-19A show exemplary embodiments having a single panel. Referring initially to FIGS. 4, 5 and 5A, an exemplary embodiment comprises a support embodied in a quadrilateral or four-sided box 210 inclusive of sidewalls 224 (224*a*, 224*b*, 224*c*, 224*d*) having at the upper extent of the sidewalls flanges 220 (220*a*, 220*b*, 220*c*, 220*d*) transverse to the sidewalls 224 for extension over a top of walls of a ventilation shaft for suspension of box 210 vertically in the shaft to define a passage 225 between top opening 226 and bottom opening 228 of box 210 for fluid communication of a ventilation duct up through box 210 to an atmospheric opening above top opening 226. Cradles 211*a*, 211*c* are formed in the upper sides of opposing sidewalls 224*a* and 224*c* respectively. The apparatus shown is suitable as a drop in solution to sealing vent passages from storm waters by lowering it into a ventilation shaft to rest on walls of the shaft. In place, a grating (not pictured) covers top opening 226. In normal operation, operator access to the interior of box 210 is through the grating.

Although an exemplary embodiment as described herein employs a quadrilateral box support 210, some locations may allow use of a support in the shape of a hollow cylinder also having stops 230 proximate a bottom opening of the support, and this form is comprehended within the scope of the invention.

Stops 230*a*, 230 *b*, 230*c* and 230*d* in the form of corner braces in box 210 are within and connected to sidewalls 224 proximate bottom opening 228 and do not obstruct passage 225. Adjacent sidewalls include a base 227 having rounded corners 227*a*, 227*d* above respective stops 230*a*, 230*d*, and a base 229 having rounded corners 229*b* and 229*c* above respective stops 230*b*, 230*c*. Rounded corners 227*a*, 227*d* and 229*b*, 229*c* have a round corner radius of curvature.

Figure 7:
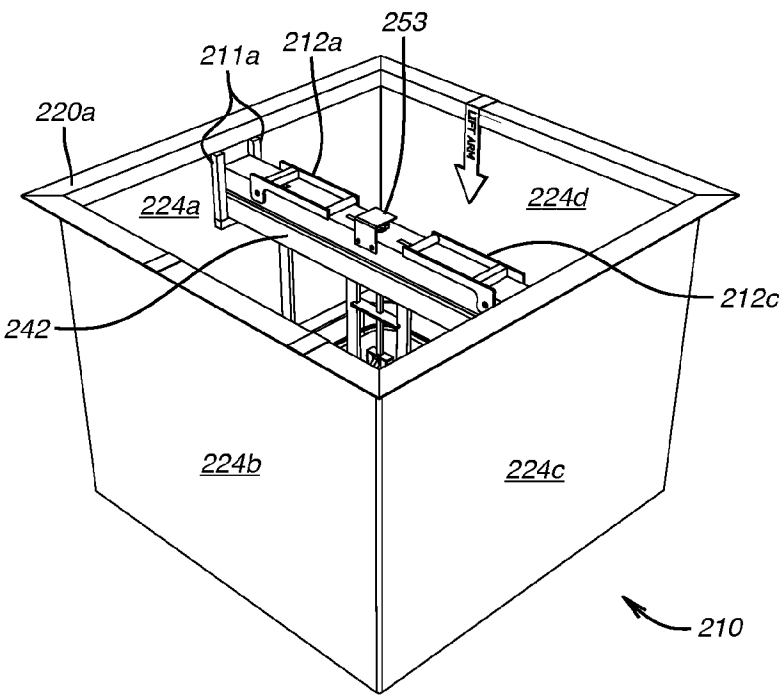
FIG. 7 is an isometric view of the panel assembly of FIG. 1 received in a quadrilateral support rotated 180 degrees from the view of FIG. 6, that is, it is a view of the opposite side of FIG. 4 (the right side).
Figure 6:
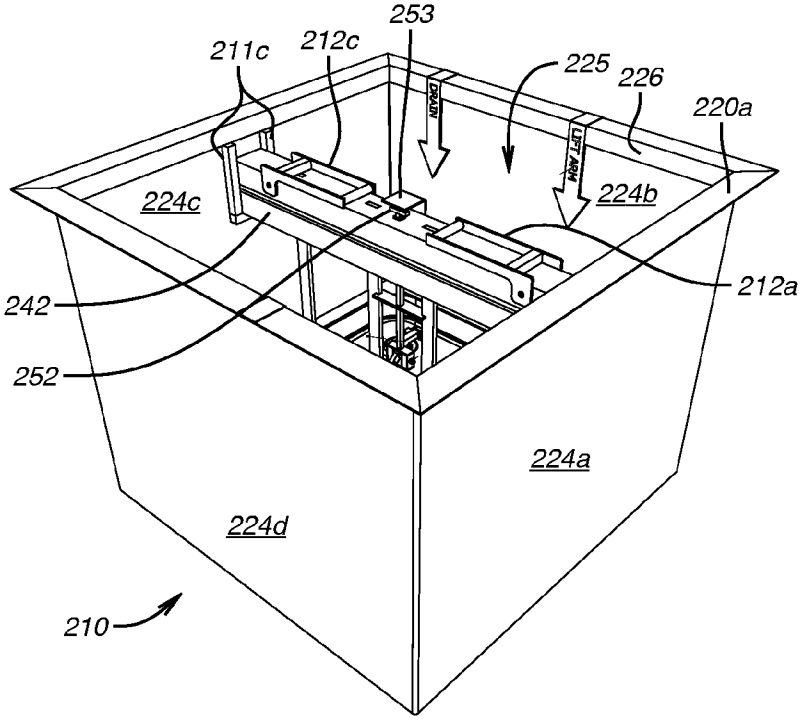
FIG. 6 is an isometric view of the panel assembly of FIG. 1 received in the a quadrilateral support viewed in this perspective from a left side.
Figure 9:
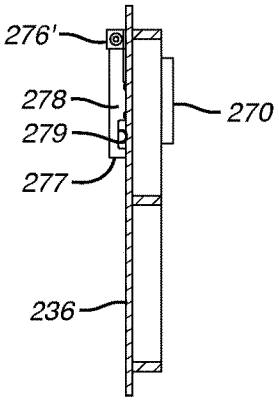
FIG. 9 is a cross sectional view of the panel of FIG. 8 taken along the line 9-9 of FIG. 8.
Figure 8:
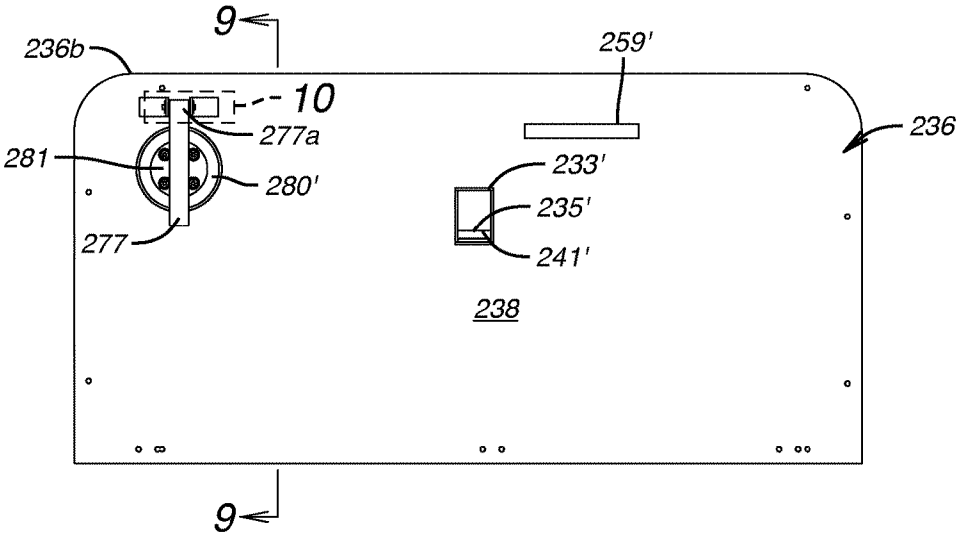
FIG. 8 is a top plan view of the panel of FIG. 2A.
Figure 11:
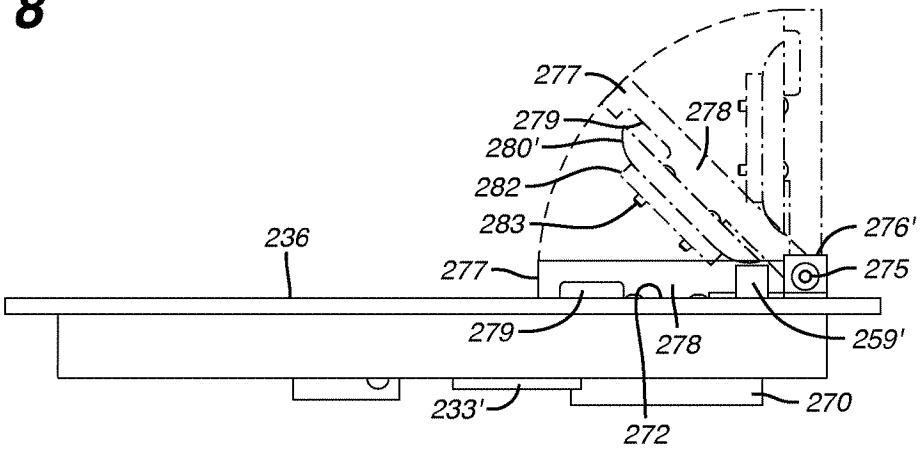
FIG. 11 is a side elevational view of the panel of FIG. 8 showing the position of a plug assembly by dashed lines in raised and partially lowered positions and in solid lines in fully lowered position.
Figure 10:
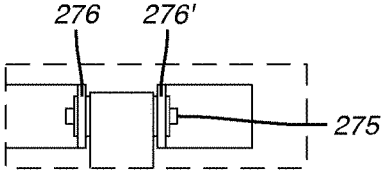
FIG. 10 is an enlargement of the area indicated by "10" in FIG. 8.
Figure 13B:
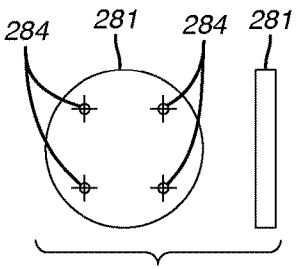
FIG. 13B is a top plan and side view of a top plate component of the plug assembly of FIG. 12 better seen in the cross section view of FIG. 13A.
Figure 13C:
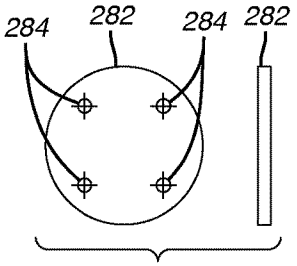
FIG. 13C is a top plan and side view of a bottom plate component of the plug assembly of FIG. 12 better seen in the cross section view of FIG. 13A.
Figure 13A:
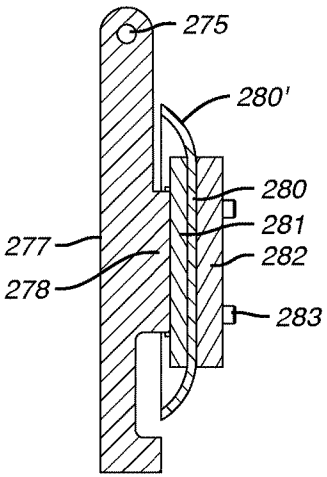
FIG. 13A is a cross section of the plug assembly of FIG. 12 taken along the line 13A-13A of FIG. 13.
Figure 13:
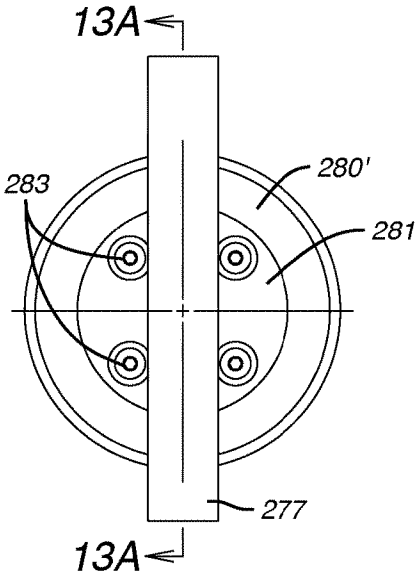
FIG. 13 is a top plan view of the plug assembly of FIG. 12.
Figure 14:
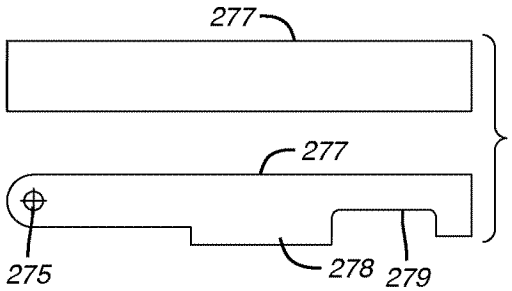
FIG. 14 is a top plan and side elevational view of a plug arm of the plug assembly of FIG. 12 also seen in the top plan view of FIG. 13 and the cross sectional view of FIG. 13A.
Figure 12:
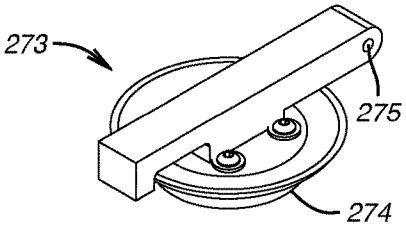
FIG. 12 is an isomeric view of a plug assembly part of the panel of FIG. 8.
Figure 13D:
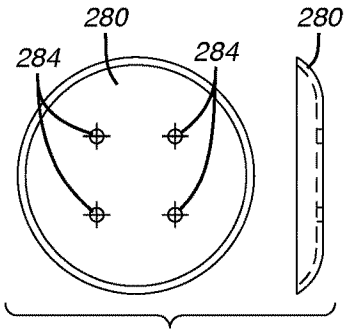
FIG. 13D is a top plan and side view of a concave sealing gasket of the plug assembly of FIG. 12 better seen in the cross section view of FIG. 13A.

Referring now to FIGS. 6 and 7, a beam 242 comprising extruded tubing unobstructively horizontally spans across passage 225 and connects to opposed sidewalls 224*a*, 224*c* of box 210 proximate top opening 226. Beam 242 is lodged in cradles 211*a*, 211*c*, and is conveniently lowered into channels 211*a*, 211*c* by operators holding beam foldable handles 212*a*, 212*c*. Beam 242 and straps 244 described below comprise a suspension member for equipment described below. Beam 242 and its attached equipment can be lowered into place as a complete assembled unit 201 after box 210 is installed in ventilation shaft resting on flanges 220. This assembled unit 201 can be removed from box 210 for servicing by withdrawing beam 242 from channels 211*a*, 211*c* by means of handles 212*a*, 212*c*.

Although an exemplary embodiment as described employs a suspension member comprising a beam 242 and straps 244 for supporting equipment described below, the scope of the invention is not limited to such embodiment. A suspension member may be employed other than beam 242 and straps 244, for example a suspension member can be a single unitary vertically extending solid or fenestrated plate suspending the hinged panels the same as beam 242 and straps 244. An advantage of the described beam 242 and straps 244 is a lighter weight imposing a lesser load on flanges 220 than a solid plate, but a fenestrated plate would serve a lighter load advantage as well, albeit likely a more costly element.

Referring particularly to FIG. 1, a hinge mounting member 245 unobstructively horizontally spans across passage 225 the same as beam 242 connected by a plurality of straps 244*a*, 244*b*, 244*c*, 244*d* to beam 242. Lodged in cradles 211*a* and 211*c*, beam 242 and hinge mounting member 245 spanning between sidewalls 224*a*, 224*c* are centered in passage 225 of box 210 with beam 242 directly over hinge mounting member 245. Hinge mounting member 245 mounts and supports a plurality of hinge members 243. Hinge members 243 each comprise a stationary member 243*b*, a movable member 243*a* and a hinge pin 243*c* that interconnects stationary member 243*b* and movable member 243*a*. Stationary member 243*b* connects to hinge mounting member 245.

A pair of opposing panels 234, 236 each having proximal and distal portions, respectively 234*a*, 234*b* and 236*a*, 236*b*, are connected at proximal portions 234*a*, 236*a* by moveable hinge members 243*a* to stationary hinge members 243*b* and thereby to a hinge mounting member 245 and from hinge mounting member 245 via straps 244*a*, 244*b* to beam 242. The connection of moveable hinge members 243*a* to the proximal portions 234*a*, 236*a* of panels 234, 236 on hinge pins 243*c* forms respective pivot axes of panels 234, 236 for vertical rotation of panels 234, 236. Panels 234, 236 rotate in directions opposite each other from or to an upright home position tucked under beam 242. Rotation of the panels upwardly (one clockwise, the other counterclockwise) to home position is effected manually as further described below. The home position of the panels tucked under beam 242 does not occlude passage 225. Panels 234, 236 in rotation fall solely under the gravitational impetus of their own weight from the upright home position to a lower passage closing position (indicated generally by reference numeral 215) where further rotation is prevented by stops 230*a*, 230*b*, 230*c*, 230*d* and 230*e*.—Each panel has a profile that closes the passage when the panels gravitationally rotate to the passage closing position.

Figure 2A:
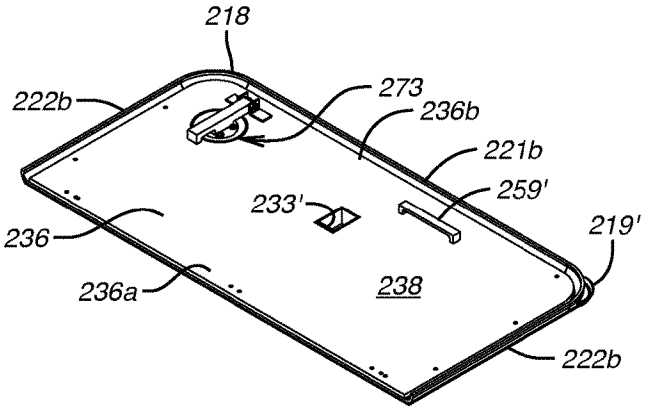
FIG. 2A is an isometric view of the top side of an embodiment of a panel on the right side of the embodiment of FIG. 1, from the same perspective as in FIG. 1.
Figure 2B:
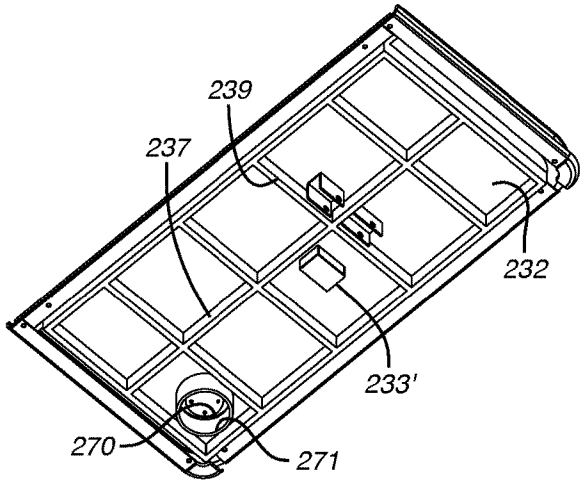
FIG. 2B is an isometric view of the bottom side of the embodiment of the panel of FIG. 6A.

Referring to FIGS. 2A-3B, Panels 234, 236 have a top side plate 238 and a bottom side 232. Bottom side 232 is crisscrossed with internal cross braces 237, 239 for rigidity. The distal portions of the panels have rounded corners 219 with a radius of curvature substantially the same as the radius of curvature of the sidewall corners 229*a*, 229*b*, 229*c* and 229*d* they sweep when rotating to the passage closing position. The panels include peripheral distal and lateral seals 221, 222 for sealing the passage in the passage closing position, seals 221*a*, 222*a* for panel 234 and seals 221*b*, 222*b* for panel 236. A gasket seal 223 (223*a* for panel 234, 223*b* for panel 236) spans the proximal ends of bases of panels 234, 236 below pin 243*c* and seals bottom opening 228 at the proximal ends of panels 234, 236 when the panels are in the passage closing position. At least one of the panels, such as panel 236 is fitted with a drain 270 intermediate the proximate and distal ends of the panel, as shown in FIGS. 2A and 2B, and further described below.

In the exemplary embodiment illustrated in FIG. 1 each panel 234, 236 topside 238 includes a recess 233 or 233'. The recess contains a panel holder latch catch 235 for panel 234, 235' for panel 236 (latch catch 235' is shielded from view in FIG. 1 but will be understood to be the same and operate the same as latch catch 235). A panel holder 240 latch 247 for panel 234, 249 for panel 236 (latch 249 is shielded from view in FIG. 1 but will be understood to be the same and operate the same as latch 247.) Panel holder 240 inclusive of latches 247, 249 is carried by the suspension member 242. Latches 247, 249 are vertically pivotal on a horizontal axis 254 at a proximate end of the latches. The latches axis 254 is parallel to the panel axes of pins 243*c* paralleling either side of hinge mounting member 245. Each panel holder latch 247, 249 pivotally extends externally from latch axis 254 distally to an inferior return having a sloped surface ending at an inset notch 251, 251'. Recesses 233, 233' and latches 247, 249 are horizontally and vertically aligned with each other such that when panel 234, 236 is rotated vertically upward, the inferior return of latch 247, 249 is brought into sliding contact with ramp 241, 241' carried by the panel and the sloped surface of the latch slides on ramp 241, 241' until inset notch 251, 251' passes over latch catch edge, 235, 235', capturing latch 247, 249. This capture holds panel 234, 236 in home position 213.

Panel holder 240 is movably suspended from suspension member 242 by a rod 246 connected to panel holder 240. Rod 246 is mounted through beam 242 vertically slideably translatable through a brace 255 fastened between straps 244*b*, 244*c* and terminates above beam 242 at T-handle 252 under a cover 253 sheltering T-handle 252 from pedestrian view through a grating covering quadrilateral support 210. Cover 253 reduces if not avoiding gratuitous tampering with the apparatus and unwanted deployment of the panels by mischief makers.

Rod 246 and T-handle 252 comprise a panel releaser. The T-handle provides convenient holding, such as by a projection or hook of a reach tool that can be vertically inserted through a small opening in a grating covering support 210 to reach under cover 253 and hook T-handle 252 for lifting panel holder 240. Lifting rod 246 by T-handle 252 moves panel holder 240 upwardly to cause moveable members 247, 249 to lose their hold on catch 241, 241' and release panels 234, 236, allowing panels 234, 236 to rotationally gravitationally fall solely by impetus of their own weight from the upright home position 213 to the lower passage closing position 215.

Panel 236 as in the depicted exemplary embodiment in FIGS. 2A, 2B, 8 and 11 is fitted with a drain 270 intermediate the proximate and distal ends of the panel. Drain 270 comprises a hollow conduit 271 passing though panel 236 and has an opening 272 open at panel top side 238. Referring particularly to FIGS. 8-16, a self actuating drain closure, indicated generally by reference numeral 273, includes a plug 274 suitably pivoting rotatably on an axis 275 parallel to the panel axis 243*c* of panel 236. Plug axis 275 is positioned between drain conduit 271 and the distal end 236*b* of panel 236. Operatively plug 274 is manually pivoted upwardly on pivot axis 275 to remove the plug from drain opening 272 while panel 236 is in the passage closing position, to drain flooding water contained in box 210 that has been prevented by panels from entering ventilation shafts guarded by apparatus 200. As panel 236 is pivotally raised upward to the home position after drainage of box 210 to allow resumption of ventilation between the atmospheric opening and the protected ventilation duct, plug 274 by force of gravity automatically pivots downward to place the plug in conduit opening 272.

More particularly, panel 236 has spaced posts 276, 276' fixedly mounted to the top side 238 of panel 236 between drain 270 and distal end 236*b* of panel 236. A pivot axis rod 275 is supported parallel to the axis 243*c* of panel 236 by posts 276, 276' and spans between the posts above top side 238 of panel 236. Drain closure 273 comprises a plug arm 277 pivotally rotating cooperatively at one end 277*a* thereof with pivot axis rod 275 for movement of arm 277 to a raised drain opening position and to a lowered drain closing position. Pivot axis rod 275 may be fixed to posts 276, 276' with plug arm 277 rotating on pivot axis rod 275, or pivot axis rod 275 may rotate in posts 276, 276' with plug arm 277 fixed to pivot axis rod 275.

Plug arm 277 comprises an attachment projection 278 remote from pivot axis rod 275. Plug 274 further comprises a concave sealing gasket 280, a top plate 281 and a bottom plate 282, both smaller in size than gasket 280. As shown in the drawings, the drain conduit 271 is a cylinder, the top and bottom plates 281 and 282 are circular discs and the concave gasket 280 is circular. Other complementary conduit, gasket and plate shapes may be used, circular being suitable and perhaps less complicated but not necessary. Concave sealing gasket 280 is secured between top and bottom plates 281 and 282 by fasteners 283 in holes 284, 284'. At least bottom plate 282 is of a size configured to enter and plug conduit opening 272. Plates 281, 282 sandwiching gasket 280 expose an outer upwardly concave gasket portion 280' extending above bottom plate 281. Plates 281, 282 are fixedly connected to plug arm 277 at attachment projection 278, thereby locating a center of gravity of plug 274 past pivot axis rod 275 in the direction of drain 270. Thus when panel 236 has plug 274 in raised position for draining box 210 with panel 236 in the passage closing position 215, and panel 236 (with plug 274 in raised position) is then rotated upwardly toward home position to restore ventilation through box 210, plug 274—by reason of gravity acting on the centered mass of the raised plug forward of plug axis 275—falls rotating downwardly from the raised position to a position parallel to panel 236, placing at least bottom plate 282 in the drain conduit opening 272, thereby closing drain conduit opening 272, with the outer upwardly concave gasket portion 280' sealing space between plates 281, 282 and opening 272.

Plug arm 274 suitably includes an inferior relief 279 intermediate the attachment projection and a terminus of arm 274 remote from rod 275 and plug axis 275 for hooking capture of plug arm 274 by a projection such as 291 on hooking reach tool 290. An operator insert tool 290 though an opening in a grating covering the support 210, hooks the inferior relief 279 and lifts tool 290 to raise the captured arm 274 to remove plug 274 from drain opening 270 to drain box 210 while panel 236 is in passage closing position 215.

Figure 15:
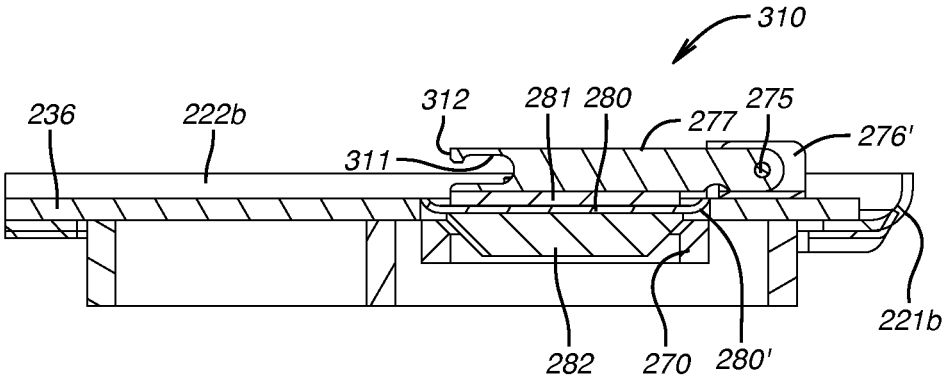
FIG. 15 is a cross sectional view of a variation of a plug assembly in place on a panel.
Figure 16:
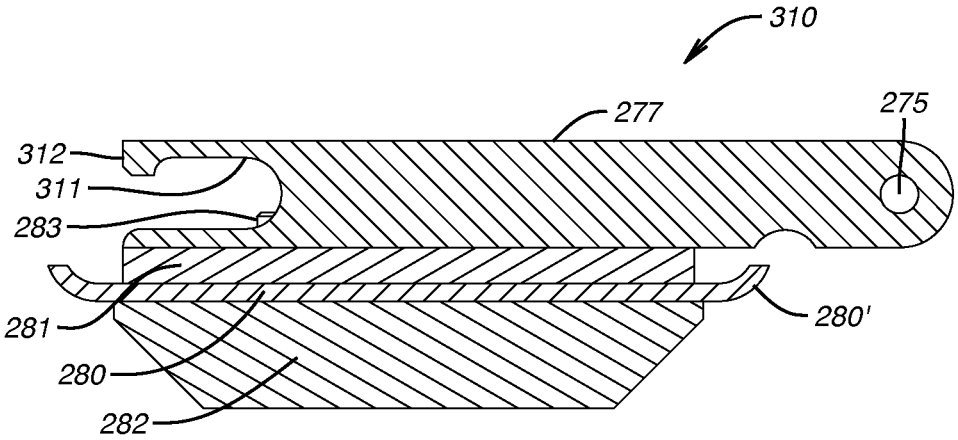
FIG. 16 is a cross sectional view of the plug arm portion of the plug assembly of FIG. 15.
Figure 17C:
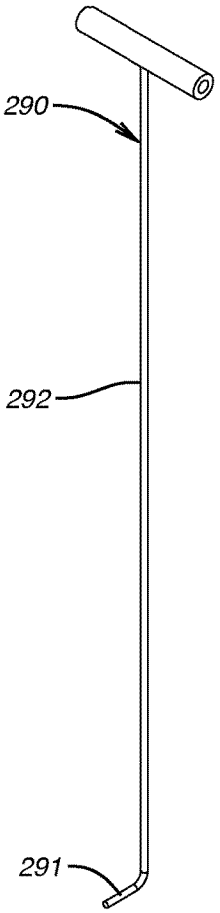
FIGS. 17A, 17B and 17C are respectively side, frontal and perspective views of a tool for manual raising of components of embodiments of the invention.
Figure 17B:
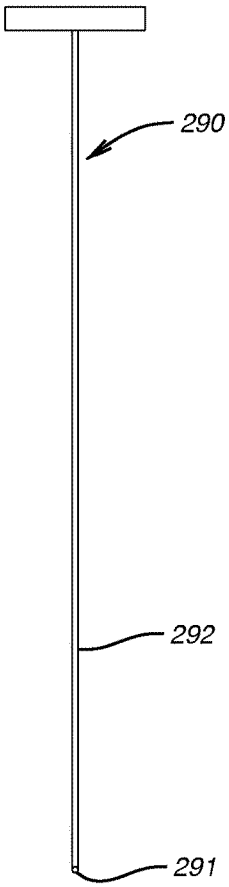
Figure 17A:
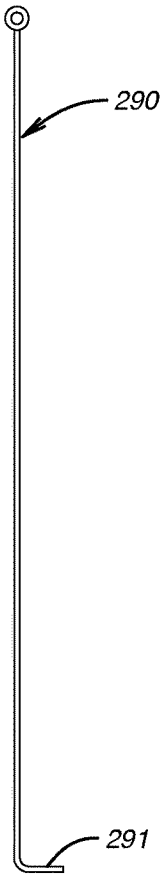

Referring to FIGS. 15 and 16, the same reference numerals are used as in FIGS. 8-12 where applicable for a variation of the plug 274. The variant plug is indicated generally by reference numeral 310. FIG. 15 compares to FIG. 11. Plug 310 places the location where a reach tool such as 290 can capture plug arm 277 at an inset 310 formed in the distal end 311 of plug arm 277 above top plate 210. Bottom plate 282 is configured to an inverted frustoconical member of greater mass and deeper reach into opening 272 of drain conduit 270, increasing the center of gravity of plug arm 277

Without the presence of self actuating drain closure 273, there is a risk that with another kind of drain closure an operator might raise panel 236 into home position with the other kind of drain closure remaining open, creating a situation where water entering box 210 through top opening 226 would enter the ventilation shaft meant to be closed when panel 236 is in passage closing position 215. The presence of the "fool proof" self actuating means for automatically closing opening 272 by the action of raising panel 236 assures that drain opening 270 is already closed when panel 236 is subsequently lowered to panel closing position 215.

Referring now to FIGS. 18-191A, another exemplary embodiment employs a single panel. Components in the single panel embodiments that are the same as in the exemplary pair of panels embodiments have the same reference numbers as in the exemplary pair of panels embodiments. The single panel exemplary embodiment, as with the other exemplary embodiments, assumes a rectilinear atmospheric opening of a vertical ventilation shaft and allows ventilation as usual through the shaft to an underground ventilation duct fluidly communicating through the ventilation shaft to an atmospheric opening at a grating over the shaft and on threat of flooding is operable to prevent downward flow of surface water into the underground ventilation duct. The single panel exemplary embodiment, like the pair of panels exemplary embodiments comprises a support embodied as a four-sided vertical box open at bottom and top to define a passage 225 between top and bottom openings of the box support. Some details are omitted for simplicity of exposition but will be understood from descriptions of the pair of panels exemplary embodiments. Exemplary flanges, e.g. 220*b*, 220*c* horizontally extend and rest atop vertical walls of a ventilation shaft (flanges 220*a*, 220*d* are not indicated by reference numerals in FIGS. 18-19A but are understood from the prior embodiments). Support box sidewalls 224*b*, 224*c* and 224*d* are visible in the sectional views FIGS. 18A and 19 A (sidewall 224*a* will be understood from descriptions of the embodiments of the pair of panels. The four sidewalls 224*a*, 224*b*, 224*c*, 224*d* of box 218 vertically fit inside the four vertical ventilation shaft walls, as in the pair of panels exemplary embodiments. Stops like stops 230*a*, 230*d* in the pair of panels exemplary embodiments are within and connected to sidewalls, respectively, 224*a*, 224*b* and 224*a*, 224*d*, proximate bottom opening like 229 in the exemplary embodiments of FIGS. 4-5A where they do not obstruct passage 225. Adjacent sidewalls include a base 227 having rounded corners 227*a*, 127*d* above respective stops 230*a*, 230*d*.

Cradles 211*a*, 211*c* are formed in the upper sides of opposing sidewalls 224*a* and 224*c* respectively, adjacent sidewall 224*d*. The apparatus shown is suitable as a drop in solution to seal vent passages from storm waters by lowering it into a ventilation shaft to rest on walls of the shaft. In place, a grating (not pictured) covers top opening 226. In normal operation, operator access to the interior of the support box is through the grating.

Referring now to FIGS. 18-19A, a beam 242 comprising extruded tubing unobstructively horizontally spans across passage 225 and connects to opposed sidewalls 224*a*, 224*c* of box 210 adjacent side wall 224*d* and proximate top opening 226. Beam 242 is lodged in cradles 211*a*, 211*c*, and is conveniently lowered into channels 211*a*, 211*c* by operators holding beam foldable handles 212*a*, 212*c*. Beam 242 and straps 244 comprise a suspension member. Beam 242 and its attached equipment can be lowered into place as a complete assembled unit after the support box is installed in ventilation shaft resting on flanges 220. This assembled unit can be removed from the support box for servicing by withdrawing beam 242 from channels 211*a*, 211*c* by means of handles 212*a*, 212*c*.

Figure 18A:
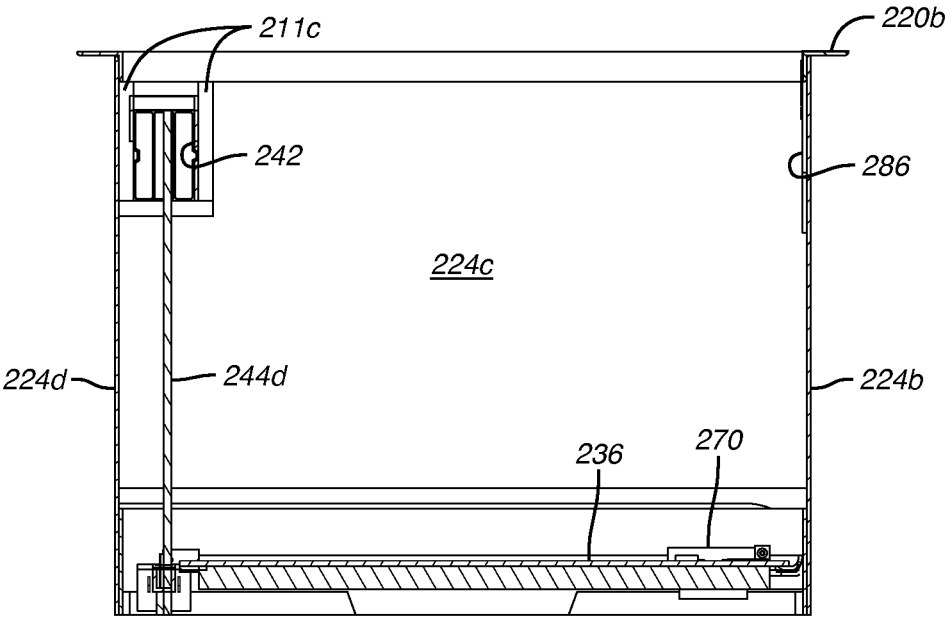
FIG. 18A is a cross sectional view of the embodiment of FIG. 18 taken along the line 18A-18A of FIG. 18.

Referring particularly to FIG. 19A, a hinge mounting member 245 unobstructively horizontally spans across passage 225 the same as beam 242 connected by a plurality of straps 244 to beam 242 (only 244*d* is seen in the sectional views of FIGS. 18A and 19A). Lodged in cradles 211*a* and 211*c*, beam 242 and hinge mounting member 245 spans between sidewalls 224*a*, 224*c* adjacent sidewall 224*d* with beam 242 directly over hinge mounting member 245. Hinge mounting member 245 mounts and supports a plurality of hinge members 243. The hinge members 243, as in the pair of panels exemplary embodiments, each comprise a stationary member 243*b*, a movable member 243*a* and a hinge pin 243*c* that interconnects stationary member 243*b* and movable member 243*a*, stationary member 243*b* connecting to hinge mounting member 245. In FIG. 19A, only moveable member 243*a* is referenced to avoid obfuscation of elements, A single panel 236 having proximal and distal portions, respectively (understood the same as 236*a*, 236*b* in the pair of panels exemplars) are connected at proximal portion 236*a* by moveable hinge members 243*a* to stationary hinge members 243*b* and thereby to a hinge mounting member 245 and from hinge mounting member 245 via straps 244*a*, 244*b*, 244*c* and 244*d* to beam 242, as in the pair of panels exemplars. The connection of moveable hinge members 243*a* to the proximal portion 236*a* of panels 236 on hinge pins 243*c* forms a pivot axis of panels 236 for vertical rotation of panel 236. Panel 236 rotates from or to an upright home position tucked under beam 242. Rotation of panel 236 upwardly (counterclockwise in the exemplary embodiment show) to home position is effected manually as further described below. The home position of panel 236 tucked under beam 242 does not occlude passage 225. Panel 236 in rotation falls solely under the gravitational impetus of its own weight from the upright home position to a lower passage closing position where further rotation is prevented by stops 230*a*, 230*d*. Each panel has a profile that closes the passage when the panels gravitationally rotate to the passage closing position.

In the embodiment illustrated in FIGS. 18-19A, panel 236 the same as panel 236 in the pair of panels exemplar includes a recess 233' that contains a panel holder latch catch 235'. A panel holder 240 latch 249 for panel 236. Panel holder 240 inclusive of latch 249 is carried by the suspension member 242. Latch 249 is vertically pivotal on a horizontal axis at a proximate end of the latches. The latch axis is parallel to the panel axes of pins 243*c*. Panel holder latch 249, like latch 247 in FIG. 6 pivotally extends externally from the latch axis distally to an inferior return having a sloped surface ending at an inset notch 251'. Recess 233' and latch 249 are horizontally and vertically aligned with each other such that when panel 236 is rotated vertically upward, the inferior return of latch 249 is brought into sliding contact with ramp 241' carried by the panel, and the sloped surface of the latch slides on ramp 241' until inset notch 251' passes over latch catch edge 235', capturing latch 249. This capture holds panel 234, 236 in home position 213. As in the case of the pair of panels exemplar, the placement of the latch and latch catch can be reversed.

As in the case of the pair of panel exemplars, panel holder 240 is movably suspended from suspension member 242 by a rod 246 connected to panel holder 240. Rod 246 is mounted through beam 242 slideably translatable through a brace 255 fastened between straps 244*b*, 244*c* and terminates above beam 242 at T-handle 252 under a cover 253 sheltering T-handle 252 from pedestrian view through a grating covering quadrilateral support 210. Rod 246 and T-handle 252 comprise a panel releaser. The T-handle provides convenient holding, such as by a projection or hook of a reach tool that can be vertically inserted through a small opening in a grating covering support 210 to reach under cover 253 and hook T-handle 252 for lifting panel holder 240. Lifting rod 246 by T-handle 252 moves panel holder 240 upwardly to cause moveable members 247, 249 to lose their hold on catch 241, 241' and release panels 234, 236, allowing panels 234, 236 to rotationally gravitationally fall solely by impetus of their own weight from the upright home position 213 to the lower passage closing position 215.

As shown in FIGS. 18-19A the single panel exemplary embodiment includes a lift arm 260' having a proximal end 261' pivotally connected by pivot pin 267 to the bottom side of panel 236 on a pivotation axis parallel to the hinge axis 243*c* and a distal end 263', the lift arm 260' being of dimension to contact distal end 263' with opposed lateral sidewall 224*b* when distal end 263' is pivoted upward inside sidewall 224*b* for exertion of lateral force onto connected panel 236 being raised with panel handle 259' to complete rotation of panel 236 into the home position.

Having described illustrative examples of embodiments that incorporate concepts of the invention, those skilled in the art will be able to use these concepts as guided by these embodiments, and may form alternative variations that nonetheless embrace the concepts herein disclosed and still be within the scope of my invention as claimed in the claims that follow.

The invention claimed is:

1. Apparatus for allowing ventilation through a vertical ventilation shaft to an underground ventilation duct fluidly communicating through the ventilation shaft to an atmospheric opening of the shaft and on threat of flooding operable to prevent downward flow of surface water into the underground ventilation duct, comprising a support comprising opposed lateral sidewalls for arrangement in said shaft defining a passage between top and bottom openings of the support for fluid communication of said ventilation duct up through said support to said atmospheric opening, one or more panels having proximal and distal ends, a top side, and a bottom side, said proximal end connecting with a horizontal hinge having a hinge axis perpendicular to said opposed lateral sidewalls for rotation of each said one or more panels upwardly to an upright home position not obstructing said passage and rotation from said home position downwardly by gravitational impetus of the weight of such panel to reach a lower passage closing position, said one or more panels having a profile that closes said passage when said one or more panels gravitationally rotates to said passage, a suspension member unobstructively horizontally spanning said passage supported on said opposed lateral sidewalls proximate said top opening and holding said one or more hinge connected panels in said passage proximate said bottom opening, a drain in at least one of said one or more panels intermediate said proximate and distal ends thereof, said drain comprising a conduit passing though said one or more panels, said conduit having an opening at said top side of said one or more panels and a self actuating drain closure on each one or more panels having the drain, said closure comprising a plug pivotingly rotatable on a drain plug axis positioned between said drain conduit and said distal end of each said one or more panels having the drain, said drain plug axis paralleling said horizontal hinge axis, said plug being manually pivotable upwardly on said drain plug axis to remove said plug from said drain opening to drain water contained above said one or more panels when each said one or more panels is in said passage closing position, said plug by gravitational impetus of the weight of the plug automatically pivoting downward to place said plug in said conduit opening when said one or more panels containing said drain is pivotally raised upward to said home position, whereby the conduit opening is already closed when the one or more panels having said drain gravitationally rotates downwardly to said passage closing position.

2. The apparatus of claim 1 in which said plug further comprises an upwardly concave sealing gasket around said plug periphery to seal any space between said plug periphery and said conduit opening when said one or more panels containing said plug is in said passage closing position.

3. The apparatus of claim 1 in which each of the one or more panels containing a said drain has spaced posts fixedly mounted to said top side of said one or more panels between said drain and said distal end of said one or more panels, and in which said drain plug axis comprises a rod supported parallel to said horizontal hinge axis by said posts and spans between said posts above said top side of said one or more panels, each said drain closure comprising:

a plug arm pivotally rotatable at a proximal end of said arm with or on said rod for movement of said arm to a raised drain opening position and to a lowered drain closing position, said plug arm comprising an attachment projection remote from said rod, an upwardly concave sealing gasket, a top plate and a bottom plate, both smaller in size than said gasket, said concave sealing gasket being secured between said top and bottom plates, at least said bottom plate being of size configured to enter and plug said conduit opening, said plates exposing an outer upwardly concave gasket portion extending above said bottom plate, said plates being fixedly connected to said arm at said attachment projection locating a center of gravity of said arm past said pivot axis of said rod in said direction of said drain, so that after said one or more panels containing said drain has said plug arm in said raised position to drain water above the one or more panels while the one or more panels is in said passage closing position, when said one or more panels containing said drain with said plug arm in raised position is rotated upwardly toward said home position, said plug arm, by reason of gravity acting on said center of gravity of said raised plug arm, rotates downwardly from said raised position to a position parallel to said one or more panels, placing at least said bottom plate in said conduit opening thereby closing said opening with said outer upwardly concave gasket portion sealing space between said plates and said opening.

4. The apparatus of claim 3 in which said plug arm includes a relief on an underside of the arm distal from said rod for capture of the arm by an arm lifting reach tool.

5. The apparatus of claim 3 in which said plug arm includes a recess on an end of the arm distal from said rod for capture of the arm by an arm lifting reach tool.

6. The apparatus of claim 3 in which said drain conduit is a hollow cylinder, said top and bottom plates are circular discs and said concave gasket is circular.

7. The apparatus of claim 3 in which bottom plate is an inverted frustoconical plate.

8. The apparatus of claim 3 in which said rod is fixed to said posts and said plug arm rotates on said rod.

9. The apparatus of claim 3 in which said rod rotates in said posts and said plug arm is fixed to said pivot axis rod.

10. The apparatus of claim 1 in which said support inclusive of said lateral sidewalls is sized to internally fit in said vertical shaft between said ventilation duct and said atmospheric opening, said support further comprising horizontal flanges transverse to said sidewalls for projecting across a top of said shaft to hang said support in said shaft.

11. The apparatus of claim 1 in which said atmospheric opening is cylindrical and said support comprises a hollow cylinder.

12. The apparatus of claim 1 in which said atmospheric opening is rectilinear and said support is quadrilateral.

13. The apparatus of claim 1 in which said suspension member comprises a single unitary vertically extending member.

14. The apparatus of claim 1 wherein said suspension member comprises a beam having vertically hung straps holding said horizontal hinge and said one or more panels connected to said horizontal hinge.

15. The apparatus of claim 14 in which said horizontal hinge comprises a hinge mounting member held by said suspension member and a plurality of hinge members mounted on said hinge mounting member.

16. The apparatus of claim 15 wherein each hinge member comprises a stationary member, a movable member and a hinge pin interconnecting the stationary and movable members, said stationary member connecting to said hinge mounting member, said moveable hinge member connecting to said proximal end of said one or more panels.

17. The apparatus of claim 1 in which said shaft is vertical and said support inclusive of sidewalls is sized to internally fit in said shaft between said ventilation duct and said atmospheric opening, said support further comprising flanges transverse to said sidewalls for overlaying a top of said shaft to hang said support in said shaft, said sidewalls supporting said suspension member.

18. The apparatus of claim 16 wherein said one or more panels comprise a pair of panels, and in which said atmospheric opening is rectilinear, said support is quadrilateral, and said suspension member comprises a beam supported centrally between said opposed lateral sidewalls for mounting of said panels in said passage for rotation of the panels in directions opposite each other from or to said upright home position not obstructing said passage, said beam having vertically hung straps holding said horizontal hinge and said panels connected with said horizontal hinge.

* * * * *